United States Patent [19]

Greer

[11] 3,969,714

[45] July 13, 1976

[54] SAFETY SYSTEM FOR CRANES

[76] Inventor: Gerald L. Greer, 1300 Westcliff Drive, Newport Beach, Calif. 92660

[22] Filed: Jan. 6, 1975

[21] Appl. No.: 538,554

[52] U.S. Cl. ..... 340/267 C; 212/39 R; 340/224

[51] Int. Cl.[2] ..... G08B 21/00

[58] Field of Search ..... 340/224, 267 C; 212/39 R, 39 MS

[56] References Cited

UNITED STATES PATENTS

| | | | |
|---|---|---|---|
| 3,127,133 | 3/1964 | Glatfelter et al. | 340/267 C |
| 3,266,638 | 8/1966 | Popov | 212/39 R |
| 3,725,887 | 4/1973 | Sneider | 340/224 |
| 3,826,321 | 7/1974 | Rigney et al. | 340/267 C |

*Primary Examiner*—David L. Trafton
*Attorney, Agent, or Firm*—Harvey C. Nienow

[57] ABSTRACT

A safety system for sensing the position of a load being carried by a crane, relative to the boom thereof. It comprises a self-powered radio transmitter positioned on the end of the boom of the crane, and an on-off switch to be engaged by a load-carrying block or hook whenever the load is in close proximity to the boom.

The system further comprises a radio receiver within the cab of the crane, such receiver being connected in circuit with suitable warning devices to energize the same upon receipt of a radio signal from the transmitter.

3 Claims, 3 Drawing Figures

SAFETY SYSTEM FOR CRANES

The present invention relates generally to warning or safety devices for cranes, but more particularly to safety devices which are employed for preventing a load from contacting the boom of a crane.

Cranes, today, are extremely large and capable of handling very heavy loads. Thus, they are useful in performing considerable work within short periods of time.

One shortcoming, however, of many cranes in operation today is the fact that the extremely heavy loads can contact and damage the boom. Such circumstances are catastrophic in that the heavy load can damage not only the boom but also many additional parts of the crane, and can cause injury or death to individuals near or within the crane.

To prevent this, some safety means has been deemed desirable for providing suitable alarm signals when the load approaches a potentially hazardous position relative to the boom.

Such large cranes have very complicated and technical boom structures, whereby the end of the boom can be moved along any coordinate axis. Frequently such booms are telescopic in construction so as to be extensible and retractable for enabling the end of the boom and hence the load carried thereby to be moved for and aft relative to the crane. Due to such complexity of the boom, it has been realized that any signal transmitting means that would go through the boom itself or through conducting means positioned along the boom, would be subject to malfunction.

In view of the foregoing, it is an object of the present invention to provide a safety system for cranes which does not employ any part of the working components of the boom for conducting a signal.

A further object of the present invention is to provide a safety system as characterized above whereby the signal identifying the unsafe condition is transmitted through the air to an instrumentality within the cab of the crane.

Another further object of the present invention is to provide a safety system as characterized above which employs radio signal transmitting means for conveying the unsafe condition to the operator within the cab of the crane.

A still further object of the present invention is to provide a safety system as characterized above which can simultaneously actuate a plurality of warning devices.

An additional object of the present invention is to provide a safety system as characterized above which is simple and inexpensive to manufacture and which is rugged and dependable in operation.

The novel features which I consider characteristic of my invention are set forth with particularity in the appended claims. The device itself, however, both as to its organization and mode of operation, together with additional objects and advantages thereof, will best be understood from the following description of specific embodiments when read in connection with the accompanying drawings, in which:

Like reference characters indicate corresponding parts throughout the several views of the drawing.

Figure 1:
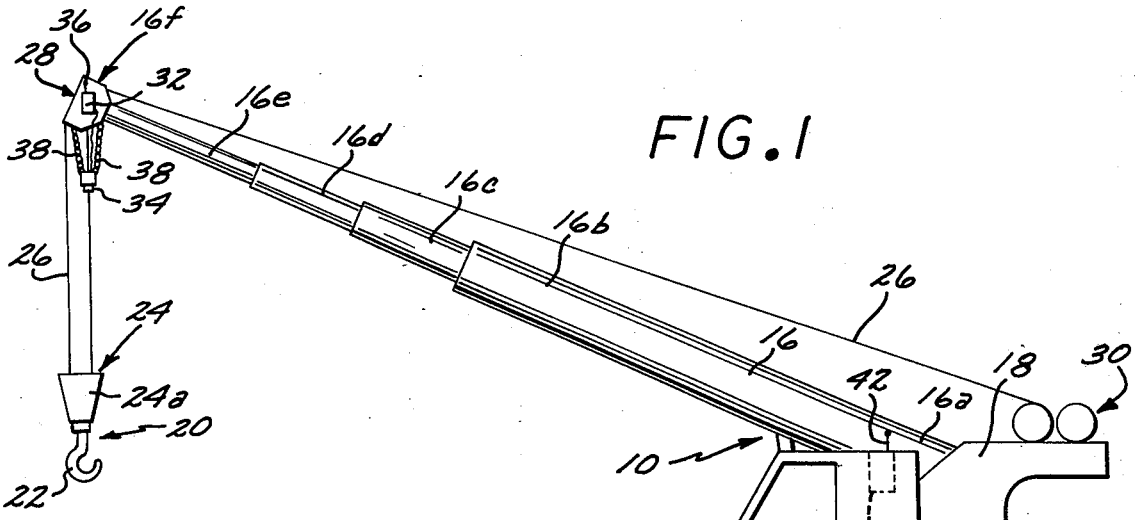
FIG. 1 is a side elevational view of a crane adapted with a safety system according to the present invention.
Figure 2:
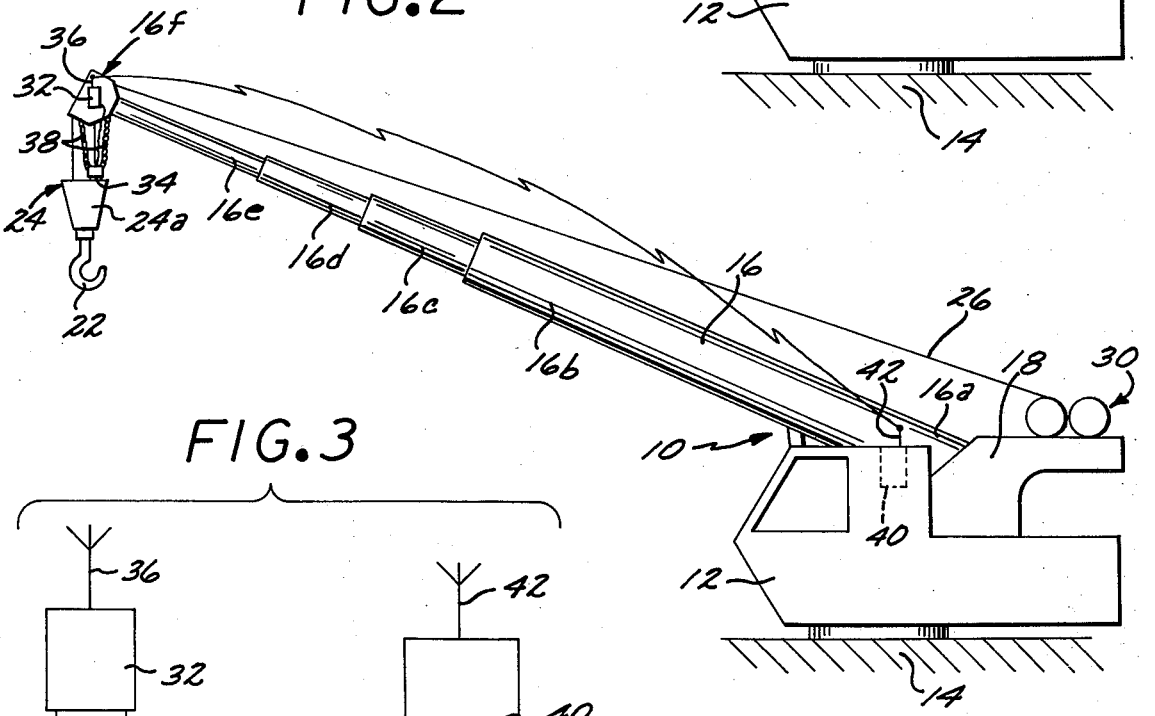
FIG. 2 is a side elevational view of the crane of FIG. 1, depicting the system in operation.

Referring to FIG. 1, there is shown therein a crane 10 having a cab 12 mounted on a suitable platform 14, said crane being pivotable within a generally horizontal plane by suitable operational means. A boom 16 is mounted on a support member 18 at its lower end 16*a*, and is comprised of telescopic sections 16*b*, 16*c*, 16*d* and 16*e*. As will be readily apparent to those persons skilled in the art, the particular construction of boom 16 is not germane to successful practice of the instant invention, but rather the subject invention can be employed with substantially any type of boom.

Load-carrying means 20 comprising a hook 22 or other appropriate means, and a pully 24 within an enclosure 24*a* therefor, is provided on a cable 26. Said cable is anchored at the end 16*f* of boom 16 and extends downwardly to and around pully 24. Such cable then extends upwardly and around another pully 28 (not shown) at the end 16*f* of boom 16 and then down to power-operated means shown schematically at 30. Thus, by suitable operation of means 30, the cable 26 can be taken up or let out so as to lift or lower the load-carrying means 20, as desired.

It will be readily realized by those persons skilled in the art that the particular type or kind of cable 26 as well as the block or pully arrangements employed is not germane to the instant invention. This, it is believed, will hereinafter become readily apparent.

Figure 3:
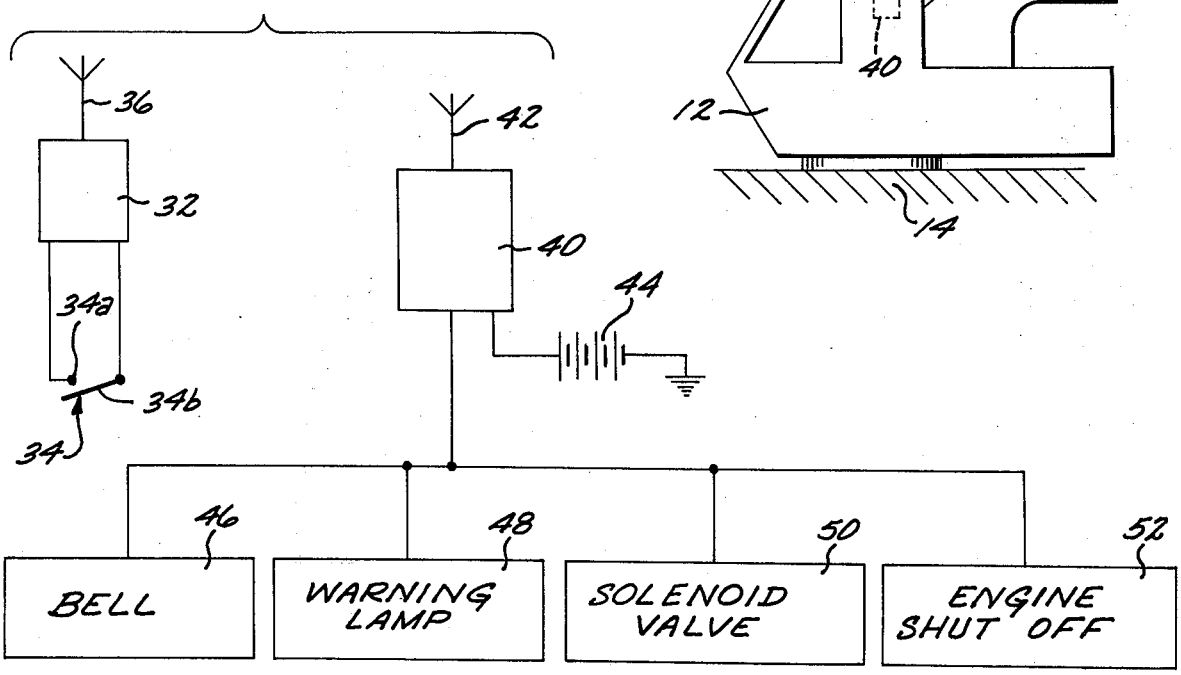
FIG. 3 is a schematic showing of some components of the subject warning system.

Mounted at the end of boom 16 is a radio signal transmitter 32 which includes an on-off operating switch 34 and an antenna 36. Switch 34 is positioned in depending relation to the end 16*f* of boom 16 by means of any appropriate means such as chains 38. The switch 34 comprises a stationary contact 34*a* and a movable contact 34*b* as shown schematically in FIG. 3 of the drawing. Such movable contact is biased to open circuit condition, as shown in FIG. 3, under the influence of gravity. In the alternative, such movable contact 34*b* may be biased to its open circuit condition by a compression spring or the like.

For successful operation of the instant invention, switch 34 is to be positioned so as to be engaged by a portion of the housing or enclosure 24*a* for pully 24. In this regard, a ledge or abutment may be formed on such housing to engage the movable contact 34*b* when the load-carrying means 24 is moved upwardly.

Positioned within the cab 12 of crane 10 is a receiver 40 having an antenna 42. Such receiver, as shown in FIG. 3 of the drawing, is connected in circuit with a source of power 44 which may be the usual source of power available for operation of the normal equipment aboard the crane 10. The source of power 44 shown in FIG. 3 is shown connected in circuit with a bell 46, a warning lamp 48, a solenoid valve 50, and the engine 52 of the crane 10. The safety devices 46, 48, 50 and 52 are connected in parallel circuit relation with each other. Thus, each such warning device is connected in series circuit relation with source 44 and receiver 40.

The receiver 40 includes a normally open electroresponsive switch (not shown) which is closed in response to receipt of a radio signal of predetermined frequency by receiver 40. When that occurs, the said switch is closed and current is permitted to flow from source 44 through one or more of the warning devices 46-52 inclusive.

The transmitter 32 is provided with its own source of electrical power as for instance long-lasting 9-volt batteries or the like. Since the switch 34 is normally open, there is no drain on such batteries during the period of time transmitter 32 is not operative. However, upon closure of switch 34, such portable source of electric power energizes the transmitter causing a signal of predetermined frequency to be transmitted from the antenna 36 thereof. Such signal is received by the antenna 42 of receiver 40 and this, in turn, causes closure of the switch within receiver 40.

Thus, the bell and warning lamp are energized, causing the audible and visual signals to be afforded thereby. The warning lamp 48 is preferably provided at the operator's console within the cab 12 for easy viewing by the operator. This is particularly desirable in that such warning is thus readily visible to the man who is operating and controlling the crane.

The solenoid valve 50 can be connected to any appropriate or suitable device which desirably should respond to the unsafe condition of the load possibly interferring with the boom 16. Also, the engine, as schematically shown at 52, can be rendered inoperable upon energization of appropriate devices in response to actuation of receiver 40.

It is contemplated within the present invention, that one or more transmitters 32 may be provided at the end 16*f* of boom 16 to transmit two or more signals at differing frequencies. The receiver 40, might be formed with several receiver sections, to individually respond to such frequencies to simultaneously energize the switch within receiver 40. Thus, the two signals would have to be transmitted before the switch closes so as to energize the various warning or control devices. This would substantially prevent unexpected signals from triggering the safety system because it would be highly unlikely that two predetermined signals would simultaneously be received by the receiver 40, other than such signals originating from transmitter 32.

It is thus seen that the present invention provides a safety system for cranes whereby upon the occurance of an unsafe condition of the load in relation to the boom, an audible or visual signal is afforded. Such system is not dependent upon a complicated arrangement of conductors within or on the movable boom.

Although certain specific embodiments of the invention have been shown and described, it is realized that many modifications thereof are possible.

I claim:

1. A safety system for cranes having a boom, a load-carrying device thereon movable with respect to said boom to raise and lower a load as desired and an operator's cab, comprising in combination, a radio signal transmitter mounted at one end of said boom and having its own portable source of electric power thereat, an on-off control switch connected in circuit with said transmitter and said source of power having at least one pair of cooperating electrical contacts and biasing means associated therewith biasing said contacts to open circuit relation to effect energization of said transmitter by said source when moved to closed circuit relation against said biasing means, said switch being suspended a predetermined distance below said one end of said boom to be operated by upward movement of said load-carrying means before it contacts said one end of said boom, and warning means including a radio signal receiver connected in circuit with the electrical energy source in the operator's cab of said crane normally used to power said crane and a warning device in said cab and in circuit with said receiver to be energized when, but only when, said receiver is receiving a signal from said transmitter.

2. A safety system for cranes having a boom, a load-carrying device thereon movable with respect to said boom to raise and lower a load as desired and an operator's cab according to claim 1, wherein said control switch is suspended from said one end of said boom over said load-carrying device.

3. A safety system for cranes having a boom, a load-carrying device thereon movable with respect to said boom to raise and lower a load as desired and an operator's cab according to claim 2, wherein a transmitting antenna is provided at said transmitter and a receiving antenna is provided at said receiver to send and receive respectively, said radio signal when but only when said switch contacts are in closed circuit position.

* * * * *